US010506856B2

(12) United States Patent
McKelvey

(10) Patent No.: US 10,506,856 B2
(45) **Date of Patent: *Dec. 17, 2019**

(54) LUGGAGE WARDROBE SYSTEM AND METHOD OF USE

(71) Applicant: Sanni McKelvey, Lee's Summit, MO (US)

(72) Inventor: Sanni McKelvey, Lee's Summit, MO (US)

( * ) Notice: Subject to any disclaimer, the term of this patent is extended or adjusted under 35 U.S.C. 154(b) by 84 days.

This patent is subject to a terminal disclaimer.

(21) Appl. No.: 15/820,164

(22) Filed: Nov. 21, 2017

(65) Prior Publication Data

US 2018/0070689 A1 Mar. 15, 2018

Related U.S. Application Data

(63) Continuation of application No. 14/976,963, filed on Dec. 21, 2015, now Pat. No. 9,820,542.

(60) Provisional application No. 62/216,492, filed on Sep. 10, 2015.

(51) Int. Cl.

| | |
|---|---|
| ***A45C 9/00*** | (2006.01) |
| ***A45C 5/03*** | (2006.01) |
| ***A45C 13/10*** | (2006.01) |
| ***A45C 13/00*** | (2006.01) |
| ***A45C 5/14*** | (2006.01) |
| ***A45C 5/06*** | (2006.01) |

(52) U.S. Cl.

CPC ..... *A45C 9/00* (2013.01); *A45C 5/03* (2013.01); *A45C 5/06* (2013.01); *A45C 5/14* (2013.01); *A45C 13/005* (2013.01); *A45C 13/103* (2013.01)

(58) Field of Classification Search

CPC .... A45C 9/00; A45C 5/03; A45C 5/06; A45C 5/14; A45C 13/005; A45C 13/103

See application file for complete search history.

(56) References Cited

U.S. PATENT DOCUMENTS

| | | | | |
|---|---|---|---|---|
| 139,420 | A | | 5/1873 | Payne |
| 850,363 | A | * | 4/1907 | Prankel ..... A47G 25/746 |
| 915,507 | A | | 3/1909 | Thomas |
| 930,343 | A | | 8/1909 | Bonsall |
| 2,639,793 | A | | 5/1953 | Hellman |
| 3,144,946 | A | | 8/1964 | Ellis |
| 4,245,763 | A | | 1/1981 | Weinberg |
| 4,267,905 | A | | 5/1981 | Stewart |
| 4,772,133 | A | | 9/1988 | Volk |
| 4,982,820 | A | | 1/1991 | Scott |
| 5,292,565 | A | | 3/1994 | Napier et al. |

(Continued)

FOREIGN PATENT DOCUMENTS

| | | |
|---|---|---|
| CA | 2081301 | 4/1994 |
| WO | 2007019379 | 2/2007 |

*Primary Examiner* — Tri M Mai

(74) *Attorney, Agent, or Firm* — Law Office of Mark Brown, LLC; Christopher M. DeBacker

(57) ABSTRACT

A luggage system with a wardrobe element which extends from the luggage portion and supports a crossbar for hanging clothing or costumes. An arm extends away from the crossbar for supporting a privacy curtain. The wardrobe element is secured within the sides of the luggage, and the opening of the luggage can be opened and closed without needing to store the wardrobe element. In a preferred embodiment, the wardrobe element includes two pairs of structural legs extending out of respective pockets within the luggage, the legs terminating at the crossbar.

16 Claims, 7 Drawing Sheets

(56) References Cited

U.S. PATENT DOCUMENTS

| | | | | |
|---|---|---|---|---|
| 5,306,063 | A | 4/1994 | Higgins et al. | |
| 5,379,870 | A | 1/1995 | Sadow | |
| 5,582,334 | A | 12/1996 | Blazer et al. | |
| 5,876,009 | A | 3/1999 | Simoncioni et al. | |
| 6,053,378 | A | 4/2000 | Doyel | |
| 6,119,835 | A | 9/2000 | Lin | |
| 6,129,254 | A | 10/2000 | Yu | |
| 6,264,047 | B1 | 7/2001 | Crumley | |
| 6,338,180 | B1 | 1/2002 | Massard | |
| 6,481,574 | B1 | 11/2002 | Pakosh | |
| 7,143,902 | B2 * | 12/2006 | Iversen | A47F 7/24 211/123 |
| 7,232,169 | B2 | 6/2007 | Porter | |
| 7,607,535 | B2 * | 10/2009 | Jackson | A45C 9/00 190/112 |
| 8,490,764 | B2 | 7/2013 | Simester | |
| 8,714,369 | B2 * | 5/2014 | Liu | A47F 7/30 211/13.1 |
| 9,101,187 | B2 | 8/2015 | Zheng | |
| 9,622,597 | B2 | 4/2017 | White | |
| 2006/0249550 | A1 | 11/2006 | Giampavolo | |
| 2007/0089952 | A1 | 4/2007 | Herbst et al. | |
| 2007/0256994 | A1 | 11/2007 | Jackson | |
| 2007/0295570 | A1 | 12/2007 | Campbell et al. | |
| 2009/0000894 | A1 * | 1/2009 | Middup | A45C 5/14 190/15 R |
| 2009/0321204 | A1 | 12/2009 | Barkow | |
| 2011/0120826 | A1 | 5/2011 | Middup | |
| 2016/0022032 | A1 | 1/2016 | Simon | |
| 2017/0071302 | A1 | 3/2017 | McKelvey | |

* cited by examiner

LUGGAGE WARDROBE SYSTEM AND METHOD OF USE

CROSS-REFERENCE TO RELATED APPLICATIONS

This application is a continuation of and claims priority in U.S. patent application Ser. No. 14/976,963, filed Dec. 21, 2015, now U.S. Pat. No. 9,820,542, issued on Nov. 21, 2017, which claims priority in U.S. Provisional Patent Application No. 62/216,492 Sep. 10, 2015, both of which are incorporated herein by reference.

BACKGROUND OF THE INVENTION

1. Field of the Invention

The present invention relates generally to a collapsible wardrobe and luggage system and method for use thereof, and more specifically to a wardrobe with a privacy curtain, the wardrobe being integrated into a trunk or other luggage, and the luggage is able to be fully closed while the wardrobe features remain extended from the luggage.

2. Description of the Related Art

Dancers, performers, travelers, or anyone else often need to quickly change clothing or costumes in public places. Typical luggage requires the user to sift through piles of clothing to find the correct article. Existing luggage with wardrobe attachments require the wardrobe bar to extend from the storage compartment of the luggage, rendering the luggage unable to close while the wardrobe feature is in use. Further, these wardrobe features are typically made to be as lightweight and cheaply as possible, typically having a single structural post extending away from the luggage on either side of the crossbar. While the luggage is open, contents stored within are susceptible to theft. These also lack the ability to provide privacy to the user when changing outfits or costumes.

What is needed is a structurally superior wardrobe element for luggage which allows the luggage to remain fully functional while the wardrobe is in use, while the wardrobe further provides privacy to the user.

Heretofore there has not been available a luggage wardrobe system or method of use with the advantages and features of the present invention.

BRIEF SUMMARY OF THE INVENTION

The present invention generally provides a luggage system with a wardrobe element which extends from the luggage portion and supports a crossbar for hanging clothing or costumes. An arm extends away from the crossbar for supporting a privacy curtain. The wardrobe element is secured within the sides of the luggage, and the opening of the luggage can be opened and closed without needing to store the wardrobe element. In a preferred embodiment, the wardrobe element includes two pairs of structural legs extending out of respective pockets within the luggage, the legs terminating at the crossbar. The preferred embodiment is ideal for use when traveling or performing, which may require the user to change multiple outfits or costumes in an otherwise public area.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Luggage Wardrobe System 2

Figure 1:
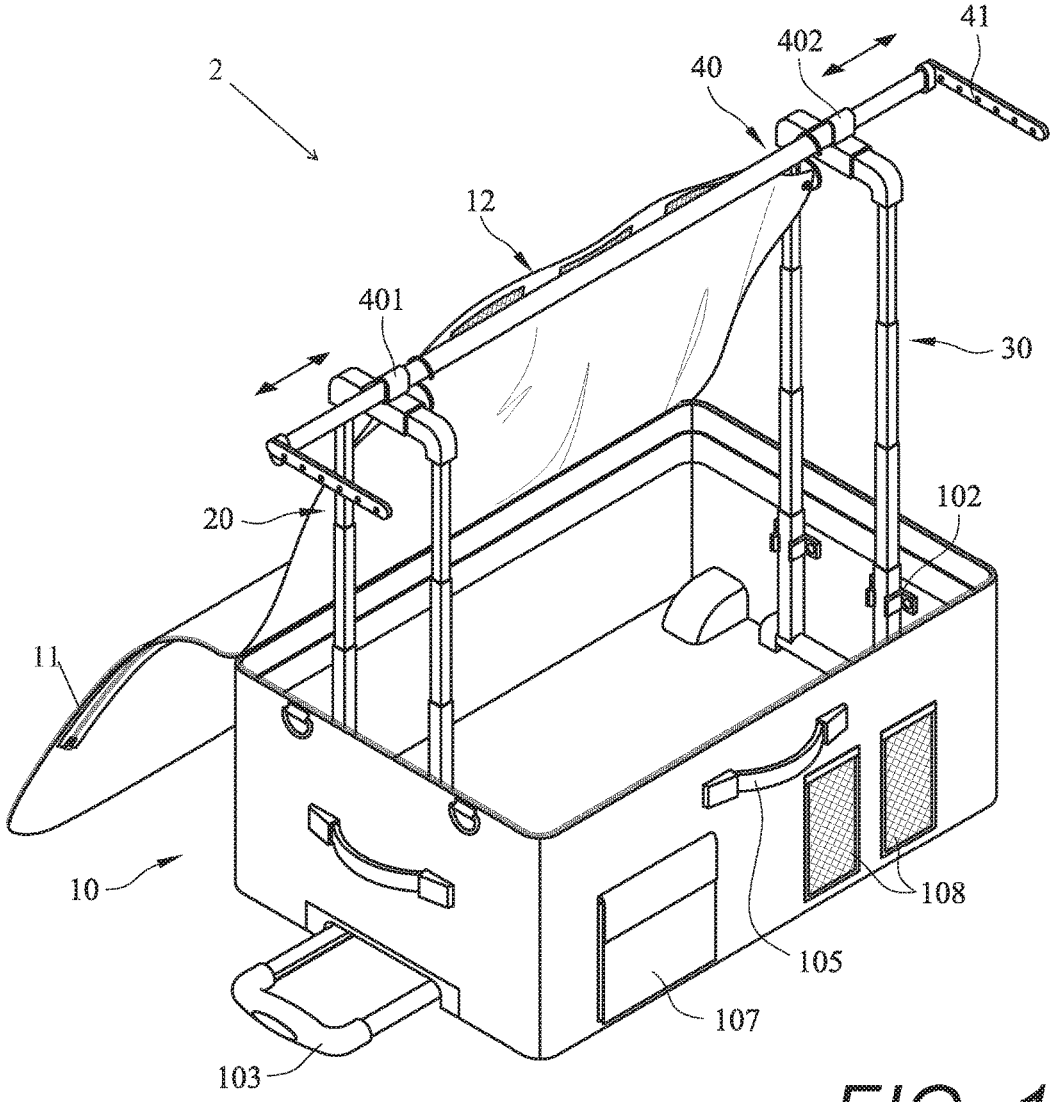
FIG. 1 is an isometric view of a preferred embodiment of the present invention in a deployed position.

FIG. 1 shows a preferred luggage wardrobe system 2 in a fully deployed position, with a first 20 and second 30 pair of supports extended outward from within the luggage storage compartment 10. The luggage storage compartment 10 generally comprise a suitcase or other typical luggage device having a storage compartment 10, a closeable lid 11, various handles for carrying the luggage, including a typical telescoping pull-handle 103, and storage compartments 108 and flaps 107 to aid in securing contents on the exterior of the storage compartment 10. Side handles 105 are also included to help the user carry the luggage compartment.

The lid 11 closes such that the first 20 and second 30 pair of supports extend through separately enclosed side passages, allowing the flap 11 to securely close over the storage compartment 10, while the supports 20, 30 remain extended. This allows the lid 11 to be securely locked or otherwise fastened shut to protect the contents of the storage compartment 10 while the supports 20, 30 are extended upward.

Figure 5:
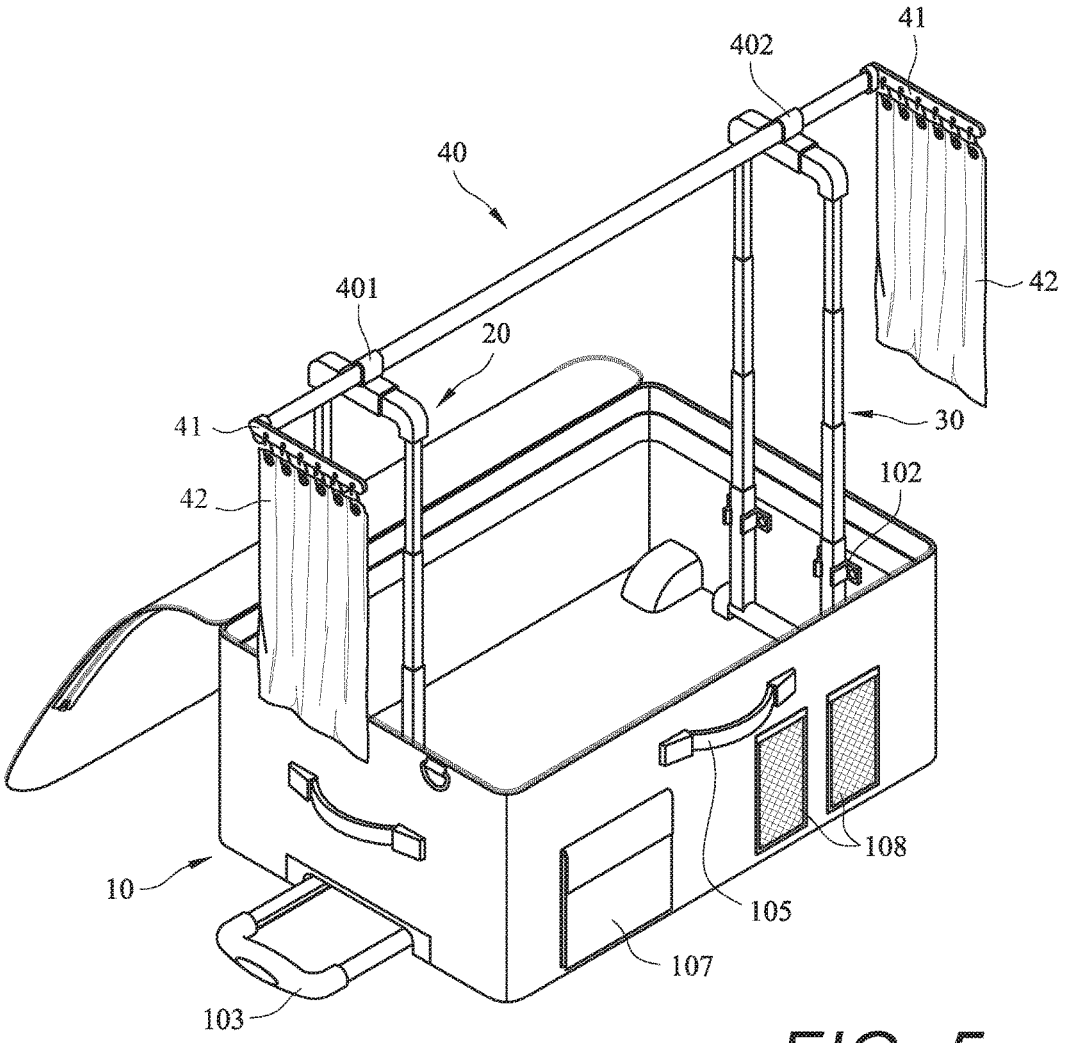
FIG. 5 is an isometric view showing privacy curtain elements as part of a preferred embodiment of the present invention.

The underside of the lid 11 includes additional an privacy screen 12 which is drawn up and attaches to the rod 40, providing additional privacy. This is shown further in FIG. 7, and stand-alone side curtains 42 are shown in FIG. 5.

A rod 40 is connected to the top of the supports 20, 30 and interfaces with rod connectors 401 and 402, respectively. This allows the rod to be placed at an elevated position ideal for receiving clothing or costumes placed on clothes hangers or other hanging elements. An optionally removable privacy curtain arm 41 connects to one or both ends of the rod 40, allowing a privacy curtain to be extended out and away from the luggage for privacy while the user is changing clothing, as shown in more detail in FIG. 5. The rod 40 may be a telescoping rod for easy storage. The lid 11 could attach to the rod 40 and/or the supports 20, 30 for additional functionality and privacy.

Figure 2:
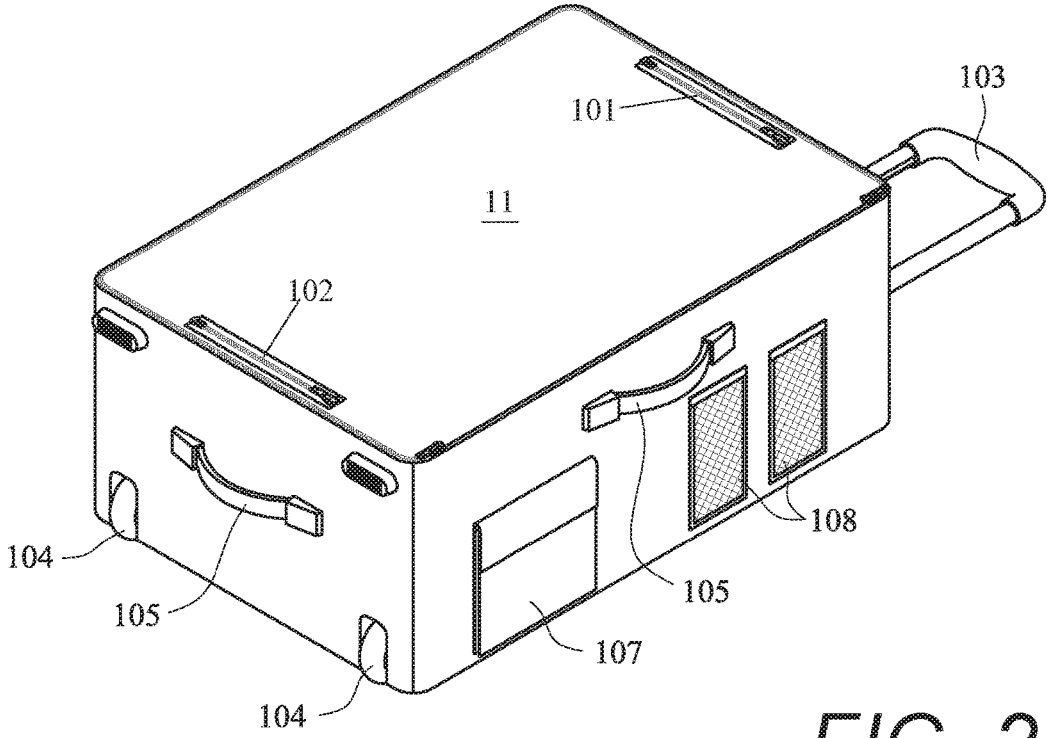
FIG. 2 is an isometric view of a preferred embodiment of the present invention in a stored position.
Figure 3:
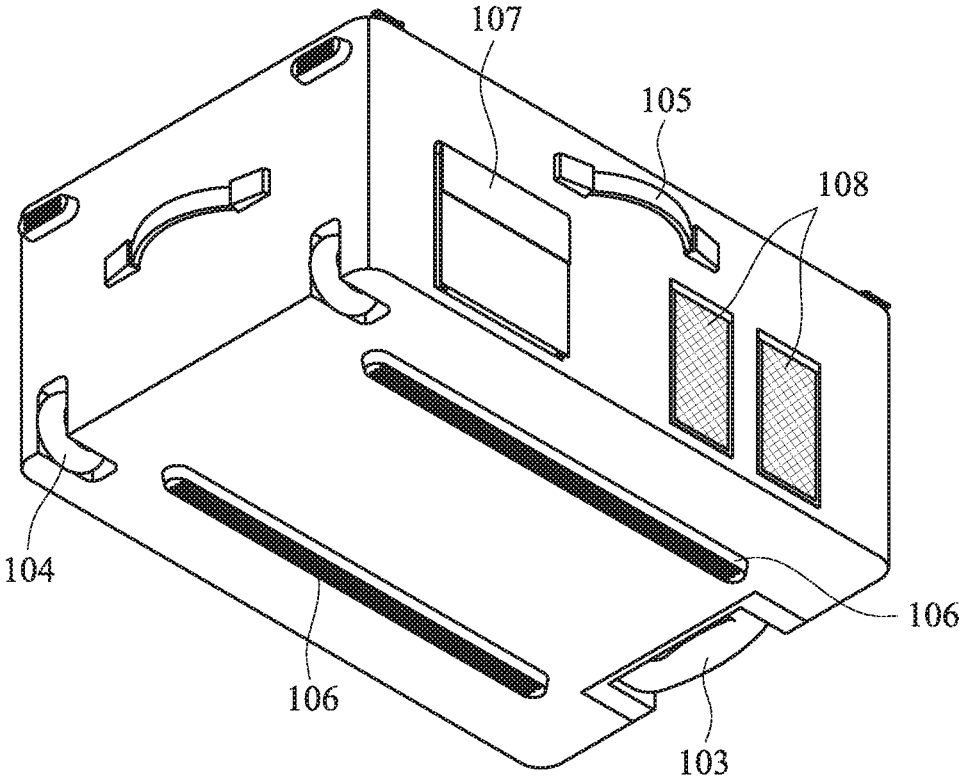
FIG. 3 is an alternative isometric view thereof.

As shown in FIGS. 2 and 3, the storage compartment 10 includes many typical features associated with luggage, such as two or four wheels 104 allowing the luggage to be easily transported. Base grip strips 106 also help protect the storage compartment 10 and prevent the compartment from sliding around while the system is deployed.

Figure 4:
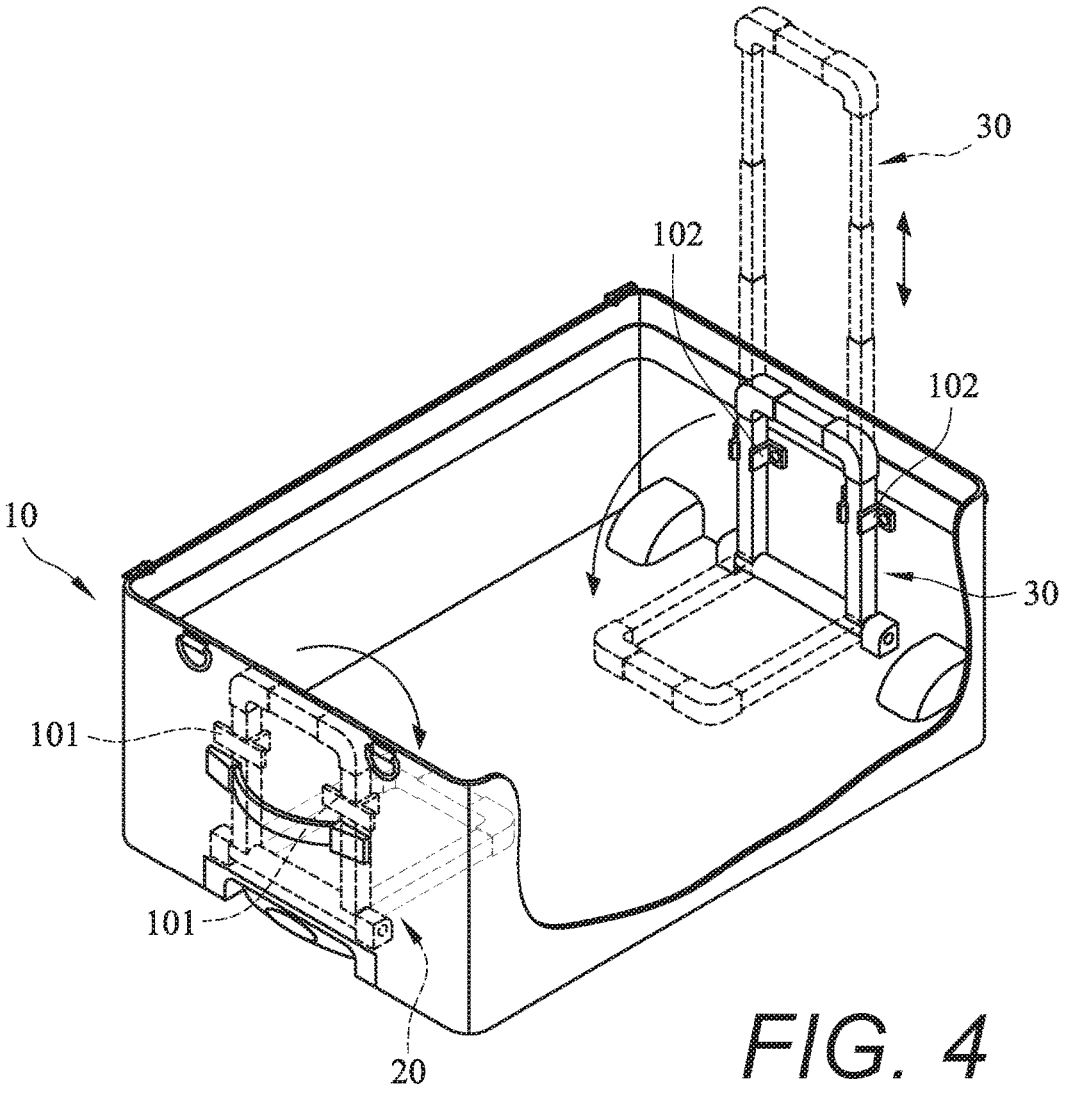
FIG. 4 is an isometric view of FIG. 2 showing a partial cut-away of the internal components thereof.

Shown slightly in FIGS. 1 and 2 but more completely in FIG. 4 are receivers 101,102 for receiving the supports 20, 30 when they are hinged up and extended. These receivers 101, 102 keep the respective supports 20, 30 upright when the wardrobe system is in its deployed position, but easily release the supports for quick and easy storage once the supports are collapsed.

FIG. 5 shows the curtain arm 41 connected to either end of the bar 40. A privacy curtain 42 hangs from each arm. The curtain could be a continuous curtain which wraps around the user for additional privacy, or they may be separate screens.

Figure 6:
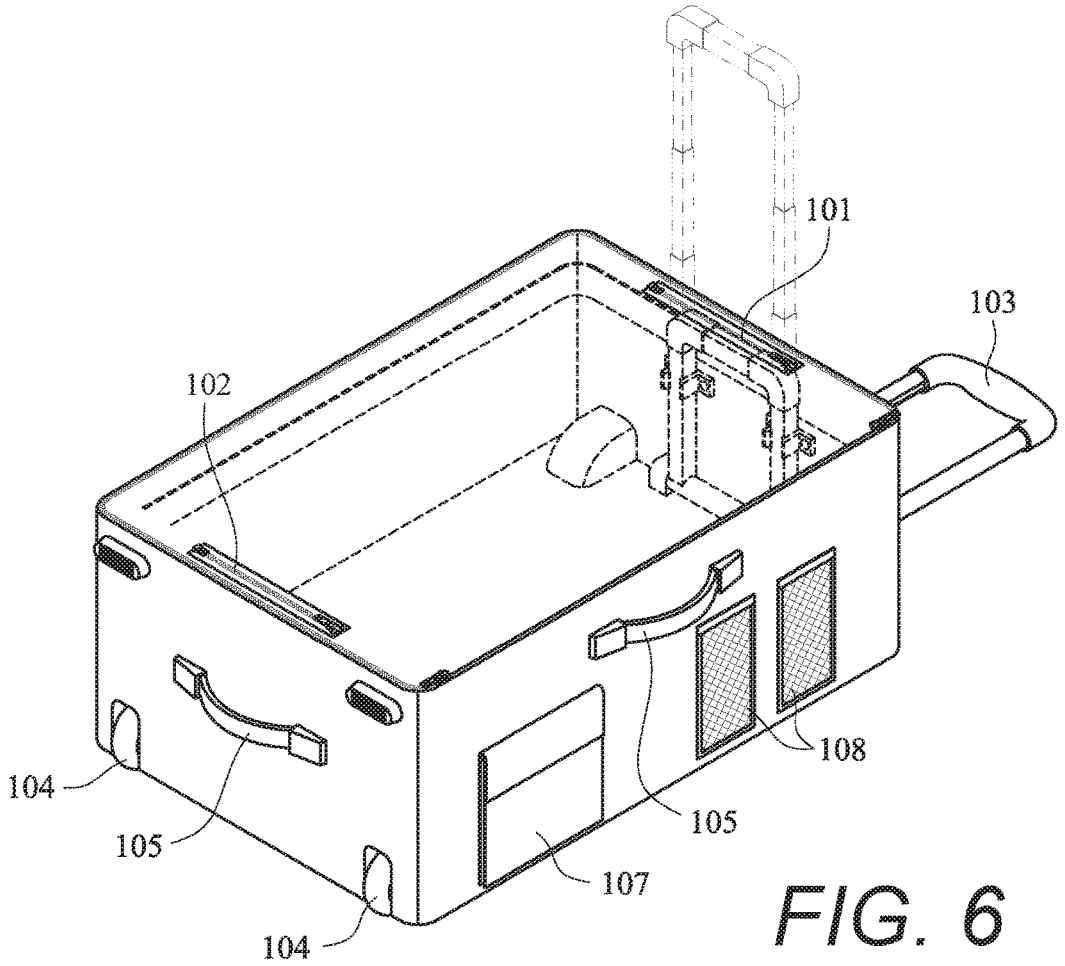
FIG. 6 is an isometric view of an alternative embodiment of the present invention including compartments for elements of the invention.

FIG. 6 shows zippered compartments 101 which store the supports 20, 30 when they are in their collapsed position, and which can open and allow the supports to extend out from the luggage while the storage compartment 10 remains closed. This allows the user to secure their items within the storage compartment while still gaining the functionality of the wardrobe bar 40 and privacy curtains 42.

When using the present invention, the user will place the wardrobe system 2 in a location where they require clothing or costumes to be changed. The user opens the storage compartment 10 and extends the supports 20, 30. The bar 40 is attached to the tops of the supports by the respective attachment clips 401, 402. The privacy curtain arms 41 are attached to one or both ends of the bar 40, and the curtains 42 are attached to the bar. The user can hang clothing on the bar 40 and change clothing in privacy. The privacy curtain arms 41 may alternatively telescope out from an end of the bar 40 and bend along a hinged attachment to a perpendicular angle from the bar. This allows the curtain arms 41 to remain with the bar 40 at all times, stored within the bar 40 when not in use, and extended from the bar and turned perpendicular to the bar about a hinge when the arm is in use.

Once set up, the user can close the top of the storage compartment 10 and allow the supports 20, 30 to extend through the zippered compartments 101. The user can lock or otherwise secure the contents of the storage compartment 10 while continuing to use the wardrobe system 2 for hanging clothes on the bar 40 and changing within the privacy of the curtains 42.

Figure 7:
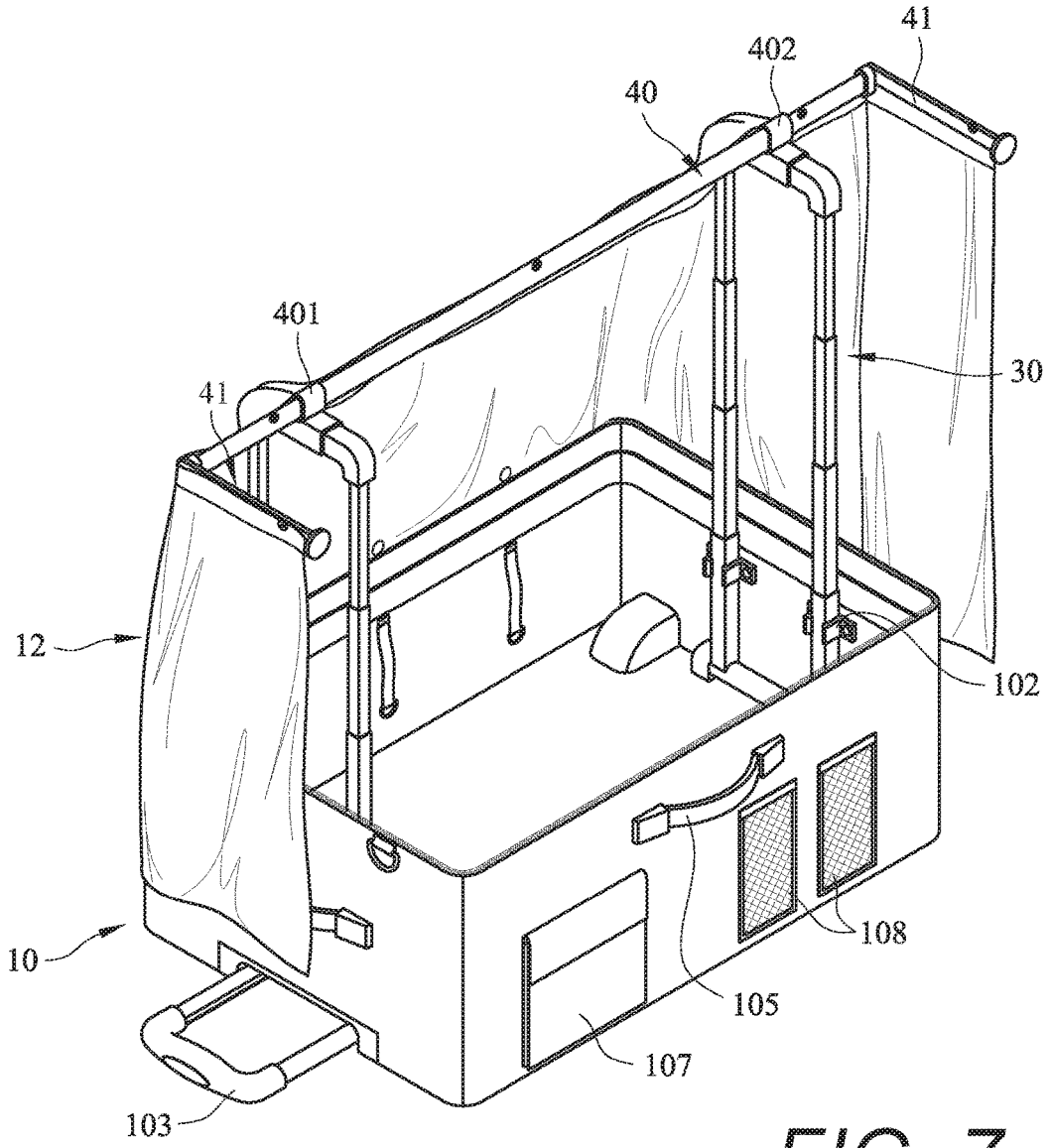
FIG. 7 is an isometric view of yet another alternative embodiment of the present invention including a privacy screen element.

FIG. 7 shows an alternative embodiment including a privacy screen 12 which is located on the underside of the lid 11, and where the screen is drawn around the sides of the container and attached to the privacy curtain arms 41. The screen can be drawn up and affixed to the horizontal rod 40. Optional slits cut in the screen allow the screen to wrap around the sides of the storage compartment 10 of the bag for additional coverage.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A wardrobe system comprising:

a storage compartment having a lid, a base, two side walls, and two end walls, said base, side walls, and end walls creating an interior space;

a pair of structural supports extending upwardly from said base of said storage compartment;

two pairs of support receivers, each pair of support receivers located on a respective end wall, said support receivers configured to releasably receive said structural supports;

a pair of rod receivers, each affixed to a respective cap of said structural supports;

a horizontal rod supported by said rod receivers;

at least one curtain arm connected to an end of said horizontal rod;

a pair of openings located in said storage compartment, each of said pair of openings corresponding with one of said pair of structural supports; and said pair of openings configured to allow access to said structural supports without opening said lid of said storage compartment.

2. The wardrobe system of claim 1, wherein said pair of openings are each sealed with a respective zipper.

3. The wardrobe system of claim 1, further comprising:

said pair of telescoping structural supports configured for a first, stored position wherein said supports are laid flush against said base of said storage compartment;

said pair of telescoping structural supports further configured to hingedly pivot to a second, upright position wherein said pair of telescoping structural supports are received by respective said support receivers; and said pair of telescoping structural supports further configured to extend to a third, deployed position wherein said pair of telescoping structural supports extend vertically beyond said interior space of said storage compartment.

4. The system of claim 1, wherein said at least one curtain arm is perpendicular to said horizontal rod.

5. The system of claim 4, further comprising:

said curtain arm configured to telescopically store within an end of said horizontal rod;

and wherein said curtain arm is further configured to bend about said end.

6. The system of claim 1, further comprising at least two wheels affixed to an exterior of said storage compartment.

7. The system of claim 1, further comprising a plurality of storage compartments affixed to an exterior of said storage compartment.

8. The system of claim 1, further comprising a privacy flap configured to temporarily attach to said horizontal rod and further configured to provide privacy behind said flap.

9. A method of deploying a portable wardrobe system, the method comprising the steps:

transporting a storage compartment to a remote location, said storage compartment comprising a lid, a base, two side walls, and two end walls, said base, side walls, and end walls creating an interior space;

opening a pair of openings within said lid;

placing a pair of structural supports extending vertically through said pair of openings beyond said interior space of said storage compartment;

placing a horizontal rod into a pair of rod receivers affixed to a cap located on said pair of telescoping structural supports; and wherein said lid of said storage compartment remains closed throughout the duration of deployment of said portable wardrobe system.

10. The method of claim 9, further comprising the steps:

telescoping said curtain arm out of said end of said horizontal rod; and bending said curtain arm about a hinge such that said curtain arm is perpendicular to said horizontal rod.

11. The method of claim 9, further comprising the steps:

drawing a privacy flap from behind said lid; and temporarily affixing said privacy flap to said horizontal rod.

12. The method of claim 11, further comprising the steps:

said privacy flap including a pair of slits separating a pair of wings from a main body of said privacy flap; and wrapping said wings about the end walls of said storage compartment.

13. A wardrobe system comprising:

a storage compartment having a lid, a base, two side walls, and two end walls, said base, side walls, and end walls defining an interior space;

a pair of structural supports extending upwardly from said base of said storage compartment;

two pairs of support receivers, each pair of support receivers located on a respective end wall, said support receivers configured to releasably receive said structural supports;

a pair of rod receivers, each affixed to a respective cap of said structural supports;

a horizontal rod supported by said rod receivers;

at least one curtain removably secured to said horizontal rod;

said pair of telescoping structural supports configured for a first, stored position wherein said supports are laid flush against said base of said storage compartment;

said pair of telescoping structural supports further configured to hingedly pivot to a second, upright position wherein said pair of telescoping structural supports are received by respective said support receivers; and said pair of telescoping structural supports further configured to extend to a third, deployed position wherein said pair of telescoping structural supports extend vertically beyond said interior space of said storage compartment.

14. The system of claim 13, wherein said at least one curtain arm is perpendicular to said horizontal rod.

15. The system of claim 14, further comprising:

said curtain arm configured to telescopically store within an end of said horizontal rod;

said curtain arm connected to said horizontal rod with a hinge; and wherein said curtain arm is further configured to bend about said hinge.

16. The wardrobe system of claim 13, further comprising:

a pair of openings located in said storage compartment, each of said pair of openings corresponding with one of said pair of structural supports; and said pair of openings configured to allow access to said structural supports without opening said lid of said storage compartment.

* * * * *